US005096539A

United States Patent [19]

Allan

[11] Patent Number: 5,096,539

[45] Date of Patent: Mar. 17, 1992

[54] CELL WALL LOADING OF NEVER-DRIED PULP FIBERS

[75] Inventor: G. Graham Allan, Seattle, Wash.

[73] Assignee: The Board of Regents of the University of Washington, Seattle, Wash.

[21] Appl. No.: 596,571

[22] Filed: Oct. 11, 1990

Related U.S. Application Data

[63] Continuation of Ser. No. 384,992, Jul. 24, 1989, abandoned.

[51] Int. Cl.[5] ..... D21C 9/00

[52] U.S. Cl. ..... 162/9; 162/162; 162/181.1; 162/181.2; 162/181.3; 162/181.4; 162/181.5; 162/181.6

[58] Field of Search ..... 162/9, 162, 181.1-181.6, 162/182, 183

[56] References Cited

U.S. PATENT DOCUMENTS

| | | | |
|---|---|---|---|
| 354,477 | 12/1886 | Just et al. | 162/88 |
| 821,434 | 5/1906 | Sachsenröder | 162/187 |
| 1,333,465 | 3/1920 | Clayton et al. | 162/187 |
| 1,815,761 | 7/1931 | Cerini . | |
| 1,842,712 | 1/1932 | Bradley et al. | 162/83 |
| 2,006,016 | 6/1935 | Eide et al. | 162/181.2 |
| 2,080,437 | 5/1937 | Rafton | 162/181.2 |
| 2,315,892 | 4/1943 | Booth | 162/181.2 |
| 2,457,797 | 1/1949 | Craig | 162/181.2 |
| 2,583,548 | 1/1952 | Craig | 162/181.2 |
| 2,599,091 | 6/1952 | Craig | 162/181.2 |
| 2,599,092 | 6/1952 | Craig | 162/181.2 |
| 2,599,093 | 6/1952 | Craig | 162/181.2 |
| 2,599,094 | 6/1952 | Craig | 162/181.2 |
| 2,823,997 | 2/1958 | Craig | 162/181.2 |
| 3,029,181 | 4/1962 | Thomsen | 162/181.1 |
| 4,388,352 | 6/1983 | Allan et al. | 427/391 |
| 4,510,020 | 4/1985 | Green et al. | 162/181.1 |

FOREIGN PATENT DOCUMENTS

| | | | |
|---|---|---|---|
| 1152266 | 6/1980 | Canada . | |
| 151381 | 6/1919 | United Kingdom . | |
| 516162 | 7/1937 | United Kingdom . | |
| 726803 | 3/1955 | United Kingdom | 162/181.3 |

OTHER PUBLICATIONS

Rydholm, *Pulping Processes*, Interscience Publishers, Sep. 1967, pp. 757-760, 1083-1088.

Casey, *Pulp and Paper*, 3rd ed. (1980), p. 1009.

Dinius, "Use of Phosphoric Acid for Brightness Control of Book Paper Containing Calcium Carbonate," *TAPPI* 41:93-96, 1958.

Arvold et al., "The Preparation and Use of Fibrous Filler in the Paper Mill," *TAPPI* 39:823-825, 1956.

Hayes, "40% Filler Loaded Paper . . . Dream of Reality?".

Denham, "Fibrous Filler—A New Pigment for the Paper Industry," *TAPPI* 38:115-116, 1955.

Green et al., "Lumen-Loaded Paper Pulp," *Pulp & Paper Canada* 83:39-43, 1982.

Stone et al., "A Study of Cell Wall Structure by Nitrogen Adsorption," *Pulp & Paper Canada* 66:407-414, 1965.

Miller et al., "The Effects of Lumen-Loading on Strength and Optical Properties of Paper," *J. Pulp Paper Sci.* 11:84-89, 1985 [Miller et al. I].

Miller et al., "Lumen-Loading: An Approach to 100% Filler Retention," *TAPPI Proceedings* 87-94, 1984, [Miller et al. II].

Scallan et al., "The Preparation of Lumen-Loaded Pulp," 613-630.

Craig, "Fibrous Filler (Hydrous Calcium Silicate)," *Pulp & Paper Canada* 116-119, 1955 [Craig I].

Craig, "Calcium Silicate-Fibrous Filler," *TAPPI* Monograph #10, 42-51 [Craig II].

*Primary Examiner*—Peter Chin

*Attorney, Agent, or Firm*—Seed and Berry

[57] ABSTRACT

There is also disclosed a process for the production of filled paper using never-dried pulp fibers and filler comprising an insoluble precipitate that is precipitated in situ within the cell wall of the fibers. The process first immerses the never-dried pulp fibers in a first solution containing a soluble salt or salts, filters the pulp fibers from the first solution, and reimmerses the never-dried pulp fibers containing the first solution in the pores into a second solution, wherein the second solution comprises soluble salt or salts different from those of the first solution and able to form an insoluble precipitate with the salt or salts of the first solution. The filled, never-dried pulp fibers are filtered and washed and either used to form filled paper products or dried to filled pulp fibers for later use in papermaking.

15 Claims, 7 Drawing Sheets

FIG. 1A
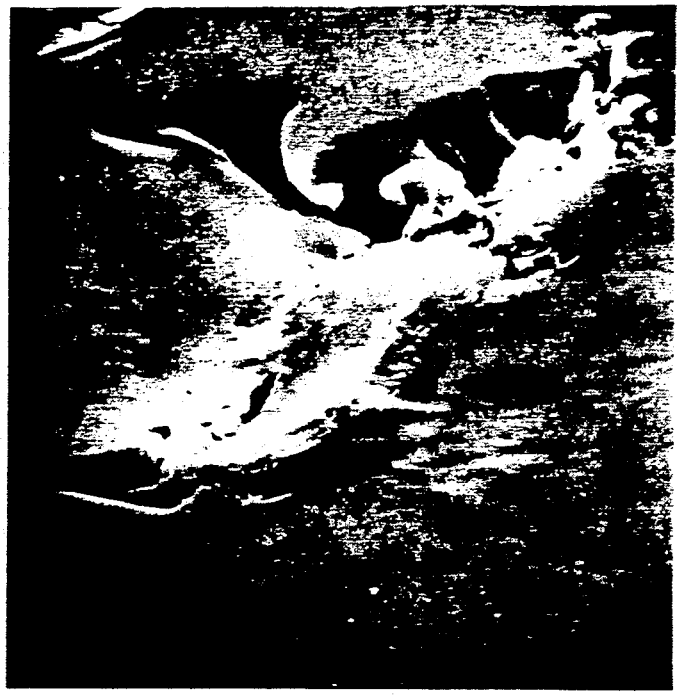
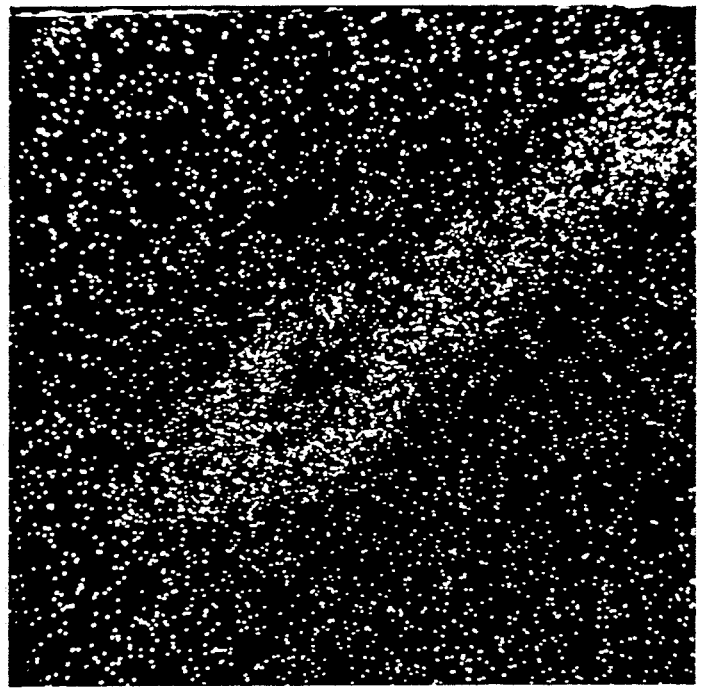
FIG. 1B

CELL WALL LOADING OF NEVER-DRIED PULP FIBERS

CROSS-REFERENCE TO RELATED APPLICATION

This application is a continuation of U.S. application Ser. No. 07/384,992 filed July 24, 1989, now abandoned.

TECHNICAL FIELD OF THE INVENTION

This invention relates to a filled paper composition wherein the filler is an insoluble precipitate predominantly located within the cell wall of never-dried cellulosic pulp fibers. The location of the filler within the cell walls determines the resulting filled paper composition having increased strength relative to a corresponding conventionally filled paper containing the same amount of the same filler.

The present invention also relates to a process for producing a filled paper composition having increased strength relative to a conventionally filled paper having the same concentration of the same filler material.

BACKGROUND OF THE INVENTION

The increasing cost of virgin pulp and the energy associated with its transformation are familiar problems to most papermakers. The boom in hardwoods utilization, the optimization of high-yield pulping processes, and the ongoing conversion to alkaline sizing are only a few examples of many attempts made in recent years to address papermaking problems. The most economically useful approach has been to replace pulp fibers with cheaper filler materials. High-filler papers are also called ultrahigh-ash paper when calcium carbonate ($CaCO_3$) is the filler. However, the major constraint of ultrahigh-ash paper is an impairment of interfibrillar bonding. This results in decreased paper strength.

Papermaking processes often use fillers or opaque pigments to confer some desirable characteristics to the paper product and to provide a cost savings for paper raw materials. Fillers can increase opacity, brightness and printing properties. Fillers are cheaper substitutes than cellulose fibers and can reduce the total cost of the finished paper product. Moreover, fillers can be dried easier than fibers and reduce energy consumption during the papermaking process.

An essential property of paper for many end uses is its opacity. It is particularly important for printing papers, where it is desirable to have as little as possible of the print on the reverse side of a printed sheet or on a sheet below it be visible through the paper. For printing and other applications, paper must also have a certain degree of brightness, or whiteness. For many paper products, acceptable levels of optical properties can be achieved from the pulp fibers alone. However, in other products, the inherent light-reflective characteristics of the fibers are insufficient to meet consumer demands. In such cases, the papermaker adds a filler.

A filler consists of fine particles of an insoluble solid, usually of a mineral origin, suspended in a slurry. By virtue of the high ratio of surface area to weight (and sometimes high refractive index), the filler particles confer light-reflectance to the paper and thereby increase both opacity and brightness. Adding fillers to paper pulp produces an enhancement of the optical properties of the paper and further produces the advantages of improved smoothness and improved printability. Further, replacing fiber with an inexpensive filler can reduce the cost of the paper. However, filler addition poses some additional problems.

One problem associated with filler addition is that the mechanical strength of the paper is less than could be expected from the ratio of load-bearing fiber to non-load-bearing filler. The mechanical strength of paper can be expressed in terms of burst index, tear index, and tensile index. The usual explanation for this is that some of the filler particles become trapped between fibers, thereby reducing the strength of the fiber-to-fiber hydrogen bonding. The hydrogen bonding is the primary source of paper strength.

There exists a practical limit to the amount of filler which can be used. The paper mechanical properties depend primarily upon hydrogen bonding between fibrous elements. Filler accumulates on the external surface of the fibers. Accumulated filler weakens the paper strength. Further, one must use increasing amounts of retention aids to avoid excessive pigment losses through the paper-forming wire. Accordingly, filler concentrations are often limited to a maximum of about 10% ash content.

Several techniques have been used to try to overcome the problems of decreased strength from increasing filler content. Most approaches have involved filler surface modification, using retention additives, and using supplemental bonding agents. For example, preflocculated fibers and fillers have been used to increase filler retention and reduce loss of paper strength. Coarser particles of pigment or filler, caused by the preflocculation procedure, are retained more efficiently than the finer particles of pigment. Thus, there is less interference with inter-fiber bonding. This helps improve paper strength. However, paper opacity is reduced with increasing particle size. Moreover, the cost savings associated with the preflocculation technique are insignificant and are offset by additional problems.

Craig, U.S. Pat. No. 2,583,548 ("Craig"), describes a process forming a pigmented cellulosic pulp by precipitating pigment "in and around" the fibers. According to Craig, dry cellulosic fibers are added to a solution of one reactant, for example, calcium chloride, and the suspension is mechanically worked so as to effect a gelatinizing of the dry fibers. A second reactant, for example, sodium carbonate, is added so as to effect the precipitation of fine solid particles, such as calcium carbonate. The fibers are then washed to remove the soluble by-product (sodium chloride).

The Craig process has considerable limitations. The presence of filler on fiber surfaces and the gelatinizing effect on the fibers are detrimental to paper strength. The gelatinized fibers are so severely broken that both the filler precipitate and the gelled fibers form a slurry. Thus, the Craig process has not achieved commercial success despite its disclosure about 39 years ago.

Another technique is described in U.S. Pat. No. 4,510,020. This process has been called the "lumen-loading" process and it involves placing the filler material directly within the lumens of soft wood pulp fibers. "Lumen-loaded" pulp is prepared by vigorously agitating a dry softwood pulp in a concentrated suspension of filler. The action of the agitation encourages the filler to move through transverse pit apertures in the fiber cell walls and into the lumen, where the filler material is adsorbed against the surface of the lumen cavity. Subsequent washing of the lumen-filled pulp fibers rapidly eliminates residual filler from the external surfaces of the fibers but only slowly from the lumen. The result is an increased retention of filler within the lumen, while removing the hindrance to inter-fiber bonding by removing the filler outside of the fiber lumens. The result is increased paper strength for the amount of filler present. The lumen-loading technique works best with fibers that have been dried.

The lumen-loading technique, however, has not proved to be economically or commercially viable. The technique requires the manipulation of large volumes of relatively concentrated filler suspensions agitated at high revolutions for prolonged periods of time. Further, the lumen-loading technique requires a relatively small particle size filler, such as titanium oxide, which is an expensive filler material. Moreover, the lumen-loading technique will only work for dry softwood fibers having a sufficient number of pit apertures. As the lumens are open at the pits, filler may be lost in the same way that it is introduced. Further, the pores in the cell walls are not filled by the lumen-loading technique.

Accordingly, there is a need in the art to be able to produce economical paper of high opacity and strength using as much filler material as possible, and to be able to use cellulosic pulp fibers from any source (e.g., softwoods, hardwoods and annual plants, such as sugarcane).

SUMMARY OF THE INVENTION

The present invention refers to a filled-paper composition comprising intact, never-dried cellulose fibers and filler, wherein at least 50% of the filler content is located within the pores or cell wall of the never-dried cellulose fibers. The filled paper composition is characterized by having increased strength compared to a corresponding conventionally filled paper containing the same amount of the same filler. The filler is formed in situ as an insoluble precipitate in an aqueous system. The paper composition may further comprise a coloring agent wherein the coloring agent is a colored precipitate formed in situ that functions as a filler material.

Examples of insoluble precipitates that function as filler materials include, for example, calcium carbonate, other precipitates listed in Table 1 herein, and combinations thereof. The paper composition is selected from the group consisting of unbleached kraft paper, bleached kraft paper, sulfite pulp (bleached and unbleached) fine printing paper, fine writing paper, and lightweight newsprint paper.

The invention further describes a process for the production of filled paper wherein the starting pulp is a never-dried pulp. The inventive process comprises dispersing the never-dried pulp in a first solution, wherein the first solution comprises a salt or salts, to form a first dispersion; filtering the pulp from the first dispersion; and redispersing the filtered, never-dried pulp in a second solution to form a second dispersion, wherein the second solution comprises a salt or salts different from the salt or salts of the first solution and with the proviso that the interaction of the salt or salts from the first solution and the salt or salts from the second solution form an insoluble precipitate that acts as a filler within the pores of the cell wall of the never-dried pulp. This forms a filled pulp fiber that can be filtered and dried or used wet for papermaking.

The paper is made by further process steps known to those of ordinary skill in the art. The pulp can be used directly for papermaking without drying, or dried as filled pulp fibers and later used for papermaking.

The present invention includes a filled paper product made from filled, never-dried cellulose pulp fibers, wherein the filled paper is made directly from the filled, never-dried pulp or the filled, never-dried pulp is made, dried, and later used to make paper. The essential steps of the inventive process are as follows:

1. Immersing (or dispersing) the never-dried pulp in a first solution, wherein the first solution comprises a soluble salt or salts;

2. Filtering the immersed, never-dried pulp and then redispersing (or reimmersing) the filtered, never-dried pulp in a second solution, wherein the second solution comprises a soluble salt or salts different from the soluble salt or salts of the first solution and with the proviso that the interaction of the salt or salts from the first solution and the salt or salts from the second solution form an insoluble precipitate in situ that acts as a filler within the cell wall or pores of the never-dried pulp; and 3. Filtering and washing the filled never-dried pulp.

The paper can be made directly with the filled, never-dried pulp fibers by conventional procedures. Alternatively, the filled, never-dried pulp can be dried and later used for papermaking.

In another embodiment, the filled, never-dried pulp fibers are beaten after filling in the never-dried state or after being once dried. If the unbeaten, filled pulp is dried, the papermaker can control the specifications of the beating process in the papermaking operation.

The never-dried cellulose pulp can be derived from hardwoods, softwoods, annual plants such as sugarcane (bagasse), and combinations thereof.

The present invention is able to load a precipitate-type filler material within the cell walls or pores located within the cell walls of never-dried pulp fibers by the internal in situ precipitation of insoluble fillers and pigments. Never-dried pulp fibers are unique in having relatively large-sized pores located within the interior of the cell wall. These pores collapse when the pulp fiber is dried and are not fully restored by the rewetting of the dried fiber. Therefore, one can optimally precipitate filler material within the cell wall surrounding the lumen only before the fiber is dried. Similarly, filled fibers, filled by the inventive process and dried, cannot be refilled by the inventive process.

Filler materials, such as pigments and opaque precipitates, are loaded into the pores of the cell walls of never-dried wood pulp fiber by precipitating the filler material inside the pores. This replaces the fluid content of the pore. Excess filler is washed away from the external surface of the fiber and an insignificant amount, if any, of filler material remains within the lumen of the fiber. As never-dried pulp fibers are hollow, tubular structures, the fibers develop an extremely large surface area after pulping and retain that large surface area while remaining wet (i.e., never-dried). The large surface area within the never-dried fibers is generously available to soluble salts that are precipitated as papermaking fillers. This preserves the bonding ability of the external cellulosic layers and does not affect the strength of the resulting paper.

BRIEF DESCRIPTION OF THE DRAWINGS

FIG. 1*a* is a scanning electron micrograph at 2142× magnification showing the surface of filled, never-dried pulp fiber filled according to the inventive process with $NiCO_3$ insoluble precipitate filler. FIG. 1*b* is an electron dispersion analysis (EDAX) of the filled fiber showing Ni location and distribution in the cell wall of the fiber.

DETAILED DESCRIPTION OF THE INVENTION

Figure 2A:
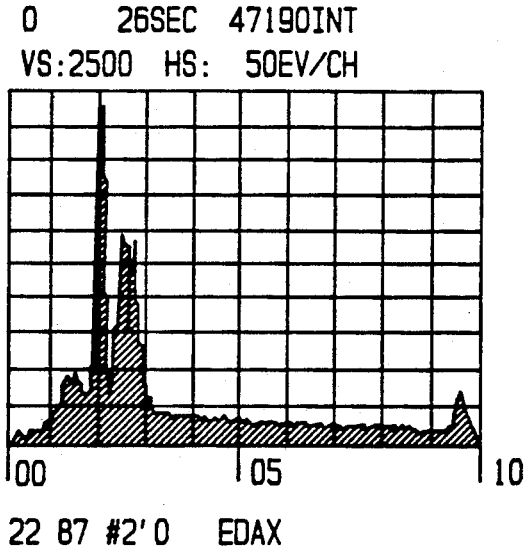
FIGS. 2*a*, 2*b*, and 2*c* are EDAX graphs of Ni (07 box) of a $NiCO_3$-filled, never-dried pulp fiber showing the surface of the fiber, the cell wall of the fiber, and the fiber lumen, respectively. Filler was predominantly present in FIG. 2*b*, indicating the presence of nickel in the cell wall.

Never-dried pulp is formed by removing the lignin and hemicellulose from cellulose wood fibers during pulping. The pulp obtained is a composite of several hundred concentric lamellae of cellulose microfibrils. Each lamella is separated from the others by water-filled spaces (pores) which vary in width from about 25 to about 300 angstroms. The larger spaces are located nearer the periphery, with the narrower spaces located toward the lumen (a central channel of about 10 to about 20 microns in width). The spacing of the pores more or less corresponds to the thickness of the lignin in the cellulose wood fiber. The pore size generally has a normal log distribution. A surprising result of the inventive process is that most of the first solution leaves the fiber lumen when the fiber is filtered between the addition of the first and second solutions. This is because the lumen is more open to the external environment than the pores in the cell wall. Thus, little, if any, filler is precipitated in situ in the lumen. The normal log distribution of pore size is a plot of the logarithm of the pore size versus pore frequency.

The never-dried pulp fiber has a surface area of about 1,000 $m^2/g$. Upon drying, the surface area reduces to about 1 $m^2/g$. Even though the lamellae swell upon rewetting, the rewetted pulp has a surface area of only about 100 $m^2/g$. Thus, upon drying, most of the pores of the never-dried pulp irreversibly collapse.

The inventive composition and processes depend upon the special properties of the never-dried pulp or its equivalents. The never-dried pulp has a large internal surface area of about 1,000 $m^2/g$ as a result of the corresponding internal cell wall pore volume of about 1.2 mL/g. The internal cell wall pores are substantially lost by collapse during drying. Anything placed within the pores before drying becomes trapped in the pores, as the pores collapse during drying.

We have shown that if never-dried pulp is sequentially treated with a first solution containing a soluble salt, such as calcium chloride, and filtered to remove the soluble salt from the exterior of the fiber and the lumen, and then a second soluble salt, such as sodium carbonate, is added, the filler, calcium carbonate, is created within these pores but not within the lumen. This process is appropriate for other filler materials when the filler is an insoluble precipitate formed from the interaction of two or more soluble salts.

When the filler is located within the cell wall by the in situ process, interference with the hydrogen bonding between fibers is reduced. As a consequence, the strength of paper made from such in situ precipitation cell wall-filled fibers is greater than the strength of paper made from the usual (conventional) combination of fibers and the same amount of filler particles added to the fibers. The conventional mixture of filler and fibers locates the filler between the fibers. Furthermore, if the filler is located inside the cell wall of the fiber in the inventive process and compositions, the abrasive filler will have less contact with the forming wire on the paper machine. This will result in fewer wire changes being needed for the paper machine in a given period of time. Moreover, there is a reduced opportunity for filler to dust off from the paper sheet because the filler is located predominantly within the cell wall of the fibers rather than outside of the fibers.

Another advantage of the inventive process and compositions is that larger amounts of filler are used to form paper and maintain the strength of the resulting paper. The paper filler does not require incorporating adhesive polymers to maintain paper strength. Thus, paper made using the inventive process without adhesive polymers can have larger amounts of filler than conventionally made paper, while retaining equal or superior strength characteristics. Since filler is generally more economical than pulp fibers, the inventive process provides an economic benefit by a lower cost of goods for the finished paper composition. Moreover, it is less energy intensive and more economical to dry filler than to dry fiber. Thus, reduced energy costs for paper forming will be achieved by reduced drying costs.

The inventive process takes never-dried pulp and precipitates a filler material in situ. In one embodiment, never-dried pulps are filled by consecutively soaking the never-dried pulp in solutions comprising a soluble salt or salts. The never-dried pulps are first soaked in a first solution for approximately five minutes or less. The first solution comprises a soluble salt or salts and functions to replace the water within the pores in the cell wall and in the lumen with a solution containing the soluble salt or salts of the first solution. The never-dried pulp fibers are filtered and washed, which removes the salt or salts from the first solution from the exterior and the lumen of the fibers. A second solution containing a different soluble salt or salts is added to the filtered fibers. The interaction of the salt or salts from the first solution within the pores of the cell wall of the never-dried pulp fibers and the soluble salt or salts of the second solution forms an insoluble precipitate that falls out of solution within the pores of the cell wall of the never-dried pulp fibers. The precipitate within the cell wall of the never-dried pulp fibers acts as a filler. When the fibers are dried or used to make paper and later dried, the insoluble precipitate acts as paper filler. The filled, never-dried pulp fibers are subsequently filtered and washed and used to form paper. Alternatively, the filled fibers may be dried and shipped to a papermaking facility as dry lap.

Pulp fibers are often beaten to certain specifications as part of the papermaking procedure. The beating of the pulp fibers occurs before forming the paper. The inventive process allows the beating to occur either before or after filling the fibers. Moreover, never-dried pulp fibers can be filled, dried and then beaten before use to form paper.

The order of the soluble salts in the first or the second solution is not important to the process. What is important is that the salt or salts of the first and second solution be different and that they form an insoluble precipitate upon interaction. Examples of white (opaque) and various colored precipitates are listed in Table 1.

TABLE 1

EXAMPLES OF PRECIPITATES USED AS FILLERS

| Color | Name | Formula |
|---|---|---|
| White | Calcium carbonate | $CaCO_3$ |
| | Aluminum phosphate | $AlPO_4$ |
| | Zinc ammonium phosphate | $Zn(NH_4)PO_4$ |
| | Calcium phosphate | $CaHPO_4$. $Ca(H_2PO_4)_2$ |
| | Magnesium ammonium phosphate | $Mg(NH_4)PO_4$ |
| | Calcium borate | $Ca(BO_2)_2$ |
| | Bismuth phosphate | $BiPO_4$ |
| | Magnesium carbonate | $MgCO_3$ |
| | Zirconium hydrogen phosphate | $Zr(HPO_4)_2$ |
| | Zirconyl hydrogen phosphate | $ZrO(H_2PO_4)_2$ |
| | Aluminum hydroxide | $Al(OH)_3$ |
| | Bismuth hydroxide | $Bi(OH)_3$ |
| | Zinc hydroxide | $Zn(OH)_2$ |
| | Titanium hydroxide | $Ti(OH)_4$ |
| | Zirconium hydroxide | $Zr(OH)_4$ |
| | Calcium silicate | $CaSiO_3$ |
| | Barium sulfate | $BaSO_4$ |
| | Barium silicofluoride | $BaSiF_6$ |

TABLE 1-continued

EXAMPLES OF PRECIPITATES USED AS FILLERS

| Color | Name | Formula |
|---|---|---|
| | Barium hydroxide | $Ba(OH)_2$ |
| | Barium orthophosphate | $Ba_3(PO_4)_2$ |
| | Barium pyrophosphate | $Ba_2P_4O_7$ |
| | Barium metasilicate | $BaSiO_3$ |
| | Barium carbonate | $BaCO_3$ |
| | Bismuth oxycarbonate | $BiO_2CO_3$ |
| | Cadmium carbonate | $CdCO_3$ |
| | Calcium metaborate hexahydrate | $Ca(BO_2)_2.6H_2O$ |
| | Calcium hydroxide | $Ca(OH)_2$ |
| | Calcium orthophosphate | $Ca_3(PO_4)$ |
| | Calcium pyrophosphate pentahydrate | $Ca_2P_2O_7.5H_2O$ |
| | Calcium sulfate | $CaSO_4$ |
| | Lead carbonate | $PbCO_3$ |
| | Magnesium metaborate octahydrate | $Mg(BO_2)_2.8H_2O$ |
| | Magnesium hydroxide | $Mg(OH)_2$ |
| | Magnesium orthophosphate | $Mg_3(PO_4)_2$ |
| | Strontium carbonate | $SrCO_3$ |
| | Strontium metasilicate | $SrSiO_3$ |
| | Strontium orthosilicate | $SrSiO_4$ |
| | Thorium hydroxide | $Th(OH)_4$ |
| | Zinc carbonate | $ZnCO_3$ |
| | Zinc orthophosphate | $Zn_3(PO_4)_2.4H_2O$ |
| | Zinc metasilicate | $ZnSiO_3$ |
| Blue | Ferric ferrocyanide (Prussian blue) | $Fe_4[Fe(CN)_6]_3$ |
| | Ferrous ferricyanide (Turnbull's blue) | $Fe_3[Fe(CN)_6]_2$ |
| | Cupric phosphate | $Cu_3(PO_4)_2$ |
| | Copper hydroxide | $Cu(OH)_2$ |
| | Copper basic carbonate | $2CuCO_3Cu(OH)_2$ |
| Violet | Chromium orthophosphate hexahydrate | $CrPO_4.6H_2O$ |
| Red | Mercurous iodide | $Hg_2I_2$ |
| | Mercuric iodide | $HgI_2$ |
| | Silver chromate | $AgCrO_4$ |
| | Bismuth iodide | $BiI_2$ |
| | | $BiI_3$ |
| | Cobalt carbonate | $CoCO_3$ |
| | Cobalt orthophosphate octahydrate | $Co_3(PO_4)_2.8H_2O$ |
| | Cobalt ferricyanide | $Co[Fe(CN)_6]_2$ |
| | Copper ferrocyanide | $Cu_2Fe(CN)_6.2H_2O$ |
| | Stannous iodide | $SnI_2$ |
| Pink | Cobalt phosphate | $Co_3(PO_4)_2$ |
| | Manganese ammonium phosphate | $Mn(NH_4)PO_4$ |
| | Cobalt orthophosphate dihydrate | $Co_3(PO_4)_2.2H_2O$ |
| | Manganese carbonate | $MnCO_3$ |
| Yellow | Cadmium sulfate | $CdS$ |
| | Cadmium molybdate | $CdMoO_4$ |
| | Barium chromate | $BaCrO_4$ |
| | Antimony sulfide | $Sb_2S_3$ |
| | Calcium chromate | $CaCrO_4.2H_2O$ |
| | Copper ferricyanide | $Cu_3[Fe(CN)_6]_2.14H_2O$ |
| | Lead chromate | $PbCrO_4$ |
| | Lead iodide | $PbI_2$ |
| | Mercurous carbonate | $Hg_2CO_3$ |
| | Molybdenum metaphosphate | $Mo(PO_3)_6$ |
| | Silver iodide | $AgI$ |
| | Silver orthophosphate | $Ag_3PO_4$ |
| | Tin sulfide | $SnS_2$ |
| Green | Chromium pyrophosphate | $Cr_4(P_2O_7)_3$ |
| | Copper metaborate | $Cu(BO_2)_2$ |
| | Copper basic carbonate | $CuCO_3Cu(OH)_2$ |
| | Nickel orthophosphate octahydrate | $Ni(PO_4)_2.8H_2O$ |
| | Nickel carbonate | $NiCO_3$ |
| | Chromic phosphate | $CrPO_4$ |
| Black | Copper sulfide | $CuS$ |

One of ordinary skill in the art would know which salts would form each precipitate.

Preferred examples of soluble salts that form an insoluble precipitate include $CaCl_2$ and $Na_2SiO_3$, yielding the precipitate $CaSiO_3$ (an opaque white filler); $BaCl_2$ and $Na_2SO_4$, yielding $BaSO_4$ (a white opaque filler); and $CaCl_2$ and $Na_2CO_3$, forming $CaCO_3$ (opaque white filler). It should be noted that it is possible to replace a sodium cation with a potassium cation in any of the soluble salts. Examples of green precipitate fillers are $NiCO_3$, formed by the combination of the aqueous salts $NiCl_2$ and $Na_2CO_3$; copper carbonate ($CuCO_3$), from cuprous chloride ($Cu_2Cl_2$) and sodium carbonate; and chromic phosphate ($CrPO_4$), from chromic chloride ($CrCl_3$) and sodium phosphate ($Na_3PO_4$). The preferred precipitate filler material is calcium carbonate ($CaCO_3$). Calcium carbonate can be formed, for example, by having one solution of calcium chloride and the other solution of sodium or potassium carbonate. In all of the insoluble precipitates that are formed, the order of use of the soluble salts is not important.

The concentration of salt or salts in the aqueous solution can vary from about 1% to about 40%, depending upon the solubility of the salt in an aqueous system, the temperature of the process, and the amount of filler desired. Preferably, the concentration of salt or salts in the aqueous solution should be as saturated as the solubility characteristics and the temperature of the process permit so as to maximize the filler content of the resulting filled, never-dried pulp fibers. When using colored or pigmented filler precipitates, it is desirable not to maximize the amount of filler in the cell wall of the never-dried fibers.

The inventive process allows for the improved retention of mechanical properties of never-dried pulp when the cell wall is loaded with a precipitated filler in situ. When never-dried pulp was filled with $NiCO_3$, formed from the soluble salts $NiCl_2$ and $NaCO_3$, the nickel precipitate can be visualized by electron dispersion analysis (EDAX).

Loaded, never-dried pulps were washed on a wire screen (mesh #100) with tap water. Microscopic observation of the washed, never-dried pulp indicated that this procedure was not efficient enough to completely remove excess filler material from around internally filled, never-dried fibers. Handsheet formation, drying, and conditioning were done in accordance with TAPPI standards. See TAPPI Official Test Method T 205 om-81 from the American National Standard, April 1982.

Figure 2B:
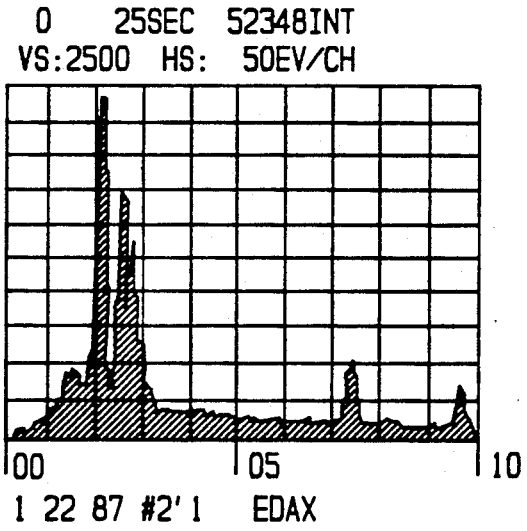
Figure 2C:
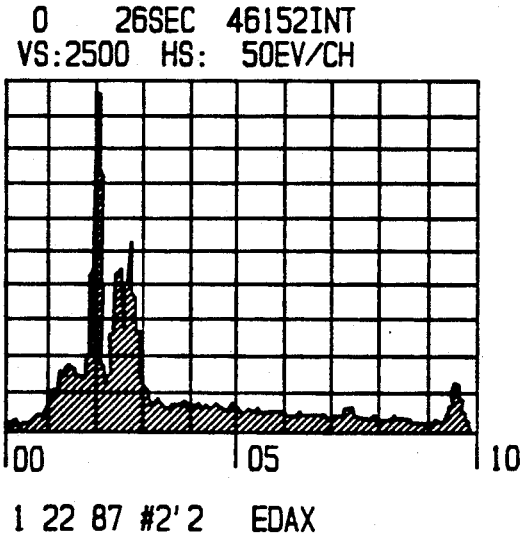

FIG. 1*a* shows the location of nickel, and FIG. 1*b* shows the nickel distribution. The white dots in FIG. 1*b* represent nickel, and the higher density of the white dots enables the fiber cell wall to be visualized. FIGS. 2*a*, 2*b* and 2*c* show different aspects of a cross section of a never-dried pulp fiber loaded with nickel carbonate filler material by a process described herein. FIG. 2*a* shows the surface of the filled, never-dried pulp fibers with essentially zero nickel present in the third box from the right. FIG. 2*b* shows a high nickel level strongly above background in a peak in the third box from the right for the cell wall areas of the fibers. FIG. 2*c* shows the nickel concentration in the lumen of the filled, never-dried pulp fiber with very little nickel present.

Paper made from never-dried fibers that have been loaded in the cell wall pores with precipitate-type filler material can be used for a wide variety of applications. The following are some of the widest categories, bearing in mind there are also many specialty products which are produced in smaller quantities.

Fine papers are a broad class of papers used for printing and writing. Generally, fine papers contain fillers. One advantage of feeding the filled, never-dried pulp fibers, filled within their cell wall to a paper machine used in making fine paper, rather than the usual mixture of separate fiber and filler, is a greater retention of the filler material within the fibers. This leads to better control of properties and cleaner machine operation. In addition to the paper being stronger than a corresponding paper conventionally filled with the same concentration of filler material, the paper made from cell wall filled, never-dried pulp exhibits less "two-sidedness." Two-sidedness is due to an unequal distribution of filler across the thickness of the sheet. Further, there is less tendency for the filler to "dust off" from the sheet during the converting processes of wetting and slitting.

Unbleached kraft pulp is used for paper products such as paper bags and wrapping papers because of its high strength. However, it has a low brightness, thus making it both unattractive and a poor substrate for printing paper. Never-dried, unbleached kraft pulp fibers with filled cell walls improve the brightness of the paper produced and less strength is lost from filler loading than with conventional loading techniques and dried pulp fibers.

Most newsprint is currently made from a mixture of mechanical and chemical pulp without filler. There is a demand for such products of lower basis weight (pulp weight per unit area). One of the barriers to achieving substantial decreases in basis weight is that such changes reduce the opacity of the sheet. Filler is not currently added to offset the loss in opacity for various reasons, including the loss of strength it causes in the sheet and the "messiness" it imparts to the papermaking operation. Using cell wall filled, never-dried pulp fibers, the newsprint problems are reduced and newsprint can be made with improved levels of opacity.

The following examples are set forth to illustrate the inventive method and compositions produced by the inventive method and not to limit the scope of the invention.

EXAMPLE 1

This example illustrates a comparison using softwood never-dried pulp from western hemlock, comparing the properties of the paper made from the inventive process and a conventional process. In each case, the pulp was beaten to 400 CSF before treatment. For the inventive process, a sample of never-dried pulp (10 g) was dispersed in a 5%, 10%, 20%, or 35% solution of $CaCl_2$ in 500 mL of water. After 30 minutes, the $CaCl_2$-impregnated fibers were collected by filtration under reduced pressure and redispersed in a saturated $Na_2CO_3$ solution (1,000 mL). After one hour, the dispersion was filtered into a 200 mesh wire screen and then washed with water until the filtrate was clear.

The never-dried pulps used for the preparation of conventionally loaded papers were also washed over a 200 mesh wire screen five times at 0.5% consistency. The conventionally filled pulp had its pH value of 8.0 adjusted using NaOH. A retention aid (Reten 210, Hercules Corp.) was added at various rates (0.5–1.5 lb/ton of pulp) to achieve the appropriate retention of the commercial $CaCO_3$ slurry. The time of agitation was one minute.

Sheets were made with both the conventional pulp and filler mixes and cell wall loaded, never-dried pulp by using TAPPI standard sheetmaking conditions. The filler ($CaCO_3$) content of the sheets was calculated by the ash content, as determined by the standard TAPPI procedure, except that the temperature of the furnace was 575° C.

Figure 3:
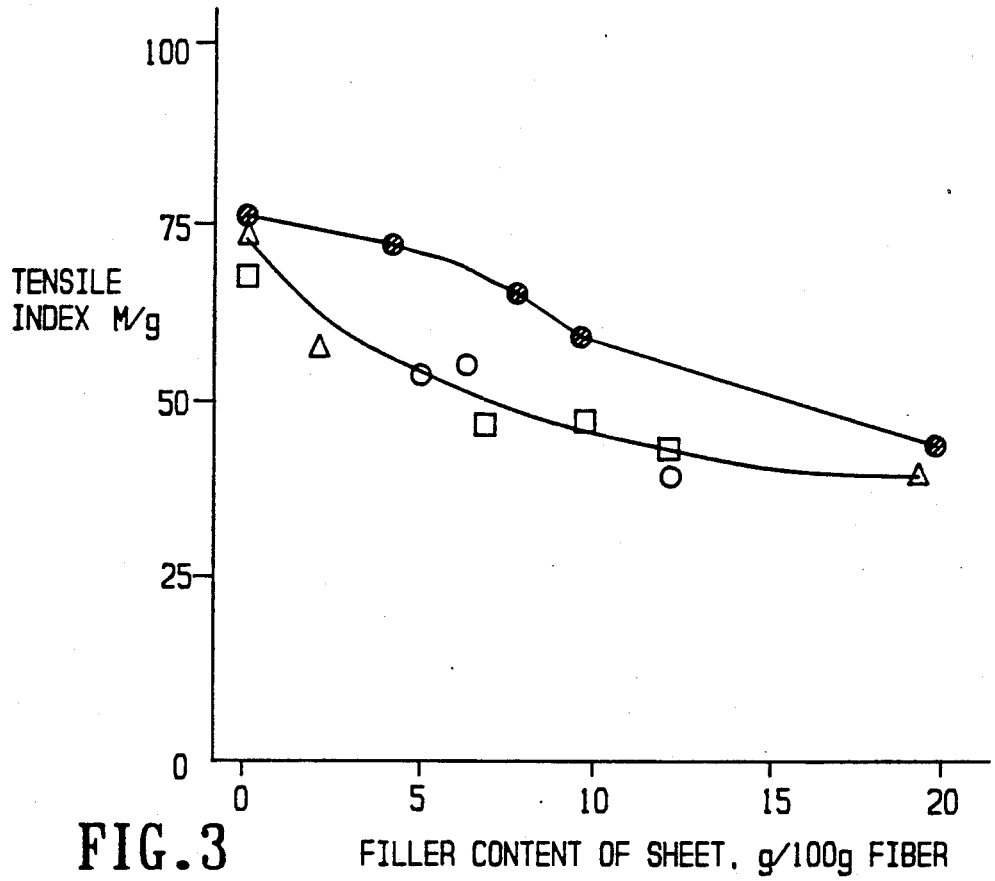
FIGS. 3 and 4 illustrate the tensile index and burst index, respectively, of different filler content papers made from never-dried western hemlock pulp (a softwood). The filled circles represent paper made from fibers filled by the inventive process, and the open circles or squares represent paper made from fibers filled by a conventional process, as described in Example 1. The different symbols represent different batches run on different dates.
Figure 4:
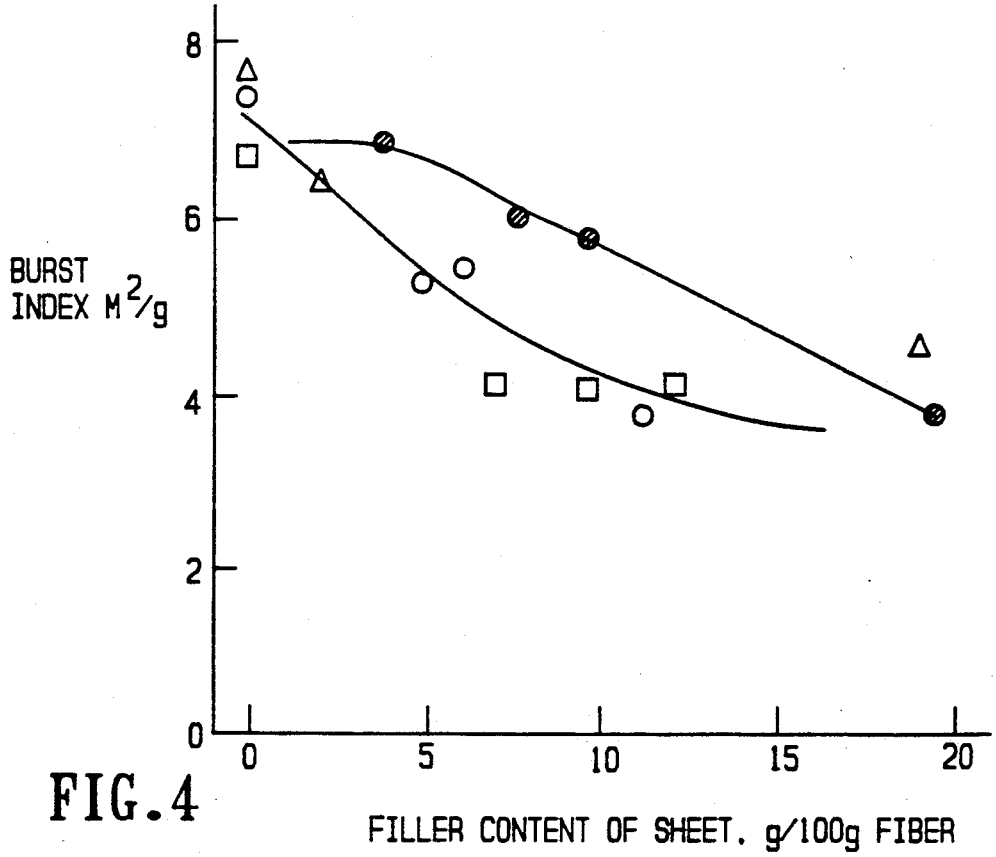

In FIGS. 3 and 4, the papers made from the cell wall loaded, never-dried pulp are shown by the closed circles. The papers made by conventional techniques are shown by the open points.

FIG. 3 shows the effect of filler level on the tensile index for conventional and cell wall loaded, never-dried pulp. These data indicate that at equal $CaCO_3$ filler concentrations, the sheets made with fibers filled by the inventive process have tensile properties superior to those made by a conventional process.

Similar comparative data are obtained in FIG. 4, where the burst strength of the papers is measured. FIG. 4 is a plot of the burst index versus filler concentration in the paper for both types of filled papers. These data demonstrate the superior burst strength values obtained using fibers filled by the inventive process.

These data indicate that the inventive process allows more filler to be added at the same paper strength or it provides for a higher level of strength at the same concentration of filler. Filled paper sells for approximately $1,000/ton or $0.50/lb when pulp costs $500/ton and filler costs $200/ton. Thus, every additional percent of filler that can be placed in a sheet instead of fiber represents a significant manufacturing cost savings of about $3–$4/ton to the papermaker. Moreover, the inventive process does not require a retention aid and thus the formation of the paper can be improved. Thus, when using a softwood kraft pulp, the inventive process improves the strength properties of the resulting paper.

EXAMPLE 2

This example illustrates a comparison of various mechanical properties of paper made with never-dried, cell wall loaded pulps from red alder versus never-dried red alder pulps combined with filler by conventional means versus once-dried red alder pulp fibers filled by the inventive process. In each instance, the never-dried pulps were initially beaten to 400 mL CSF prior to filler loading by either technique. The methods used for filling red alder pulps by the inventive process or combining by the conventional techniques are described in Example 1. Calcium carbonate was provided as a slurry for the conventional technique or precipitated in situ according to the inventive process. The concentration of filler was determined from the ash content.

Figure 5:
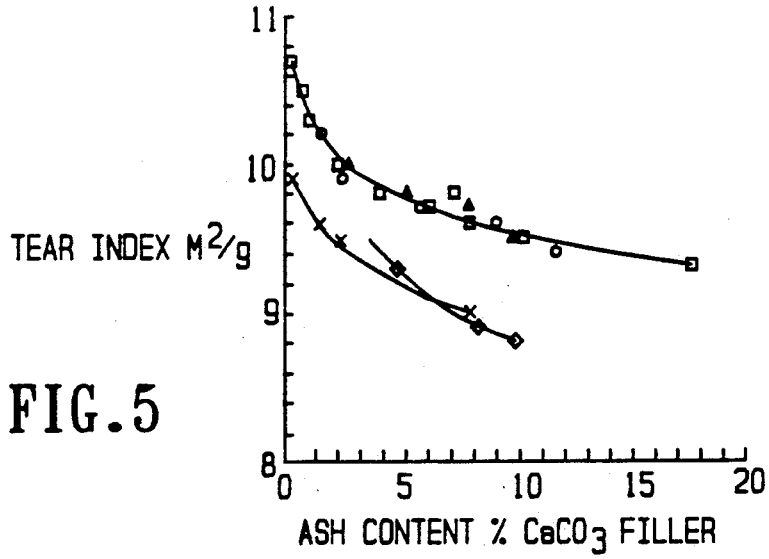
FIGS. 5, 6 and 7 illustrate tear index, burst index, and tensile index, respectively, for different filler content papers made from red alder pulp (a hardwood). The open circles or squares represent the inventive process with $CaCO_3$ as the filler precipitated in situ, wherein, for the open squares, $CaCl_2$ was the first salt and $Na_2CO_3$ was the second salt, and for the open circles, $Na_2CO_3$ was the first salt and $CaCl_2$ was the second salt. The closed triangles are data from paper made from mixtures of cell wall filled and unfilled fibers in ratios of 1:3, 1:1, and 3:1, respectively. The open diamonds are red alder, never-dried pulp fibers filled by the conventional techniques described in Example 1. The "x" designation used once-dried red alder pulp, rewetted and filled by the inventive process.
Figure 6:
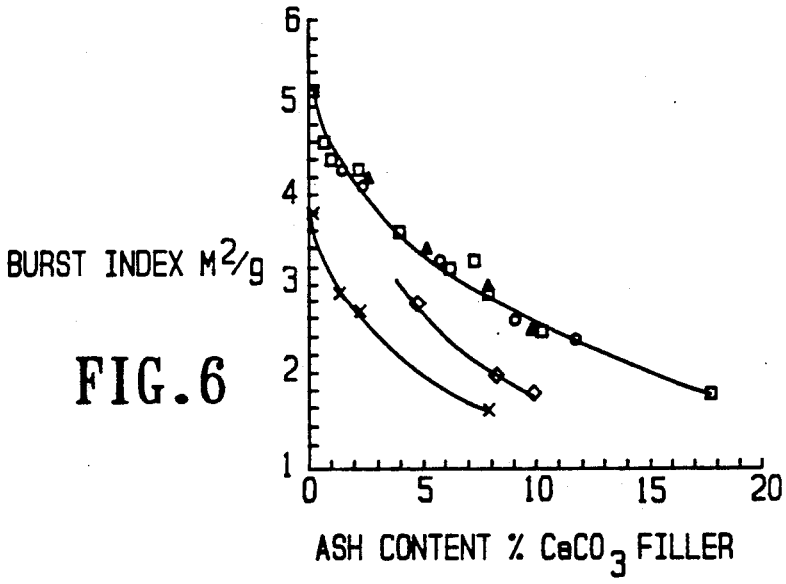
Figure 7:
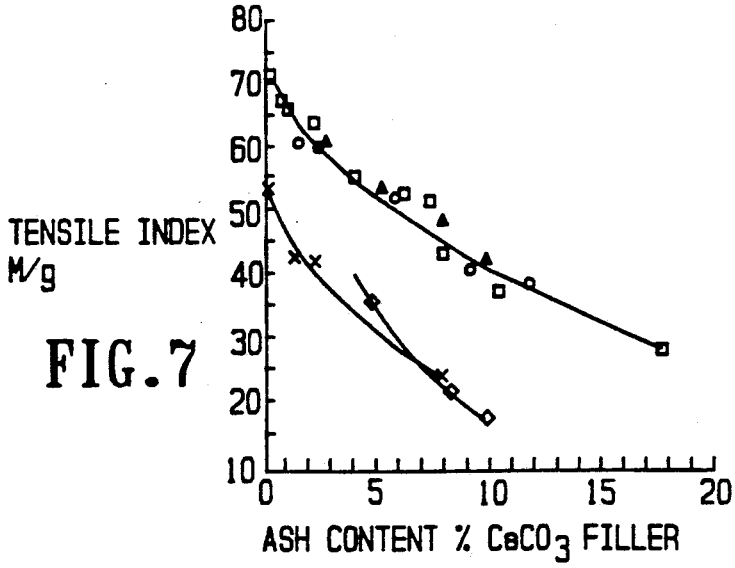

FIGS. 5, 6, and 7 compare the tear index, burst index, and tensile index, respectively, comparing red alder never-dried pulps filled by the inventive process or by the conventional technique. In each illustration, the ash content indicates the percent of filler in the paper. Therefore, in each figure it is possible to compare the tear index, burst index, and tensile index of paper made from each type of filled fiber at equivalent filler concentrations.

In FIGS. 5, 6, and 7, the upper line with the higher tear burst or tensile indices is for papers made with fibers filled by the inventive process. The squares represent never-dried pulp fibers filled wherein the sequence of solution addition is first calcium chloride followed by sodium carbonate and the circles have the reverse sequence of sodium carbonate followed by calcium chloride. The lower line with the X-shaped points represents once-dried pulp fibers filled by the inventive process. The lower line with the diamond points represents conventionally loaded, never-dried pulps.

In each instance, the strength of the resulting paper, as measured by tear index, burst index, and tensile index, was higher for the inventive process using never-dried pulp fibers. Further, the order of addition of the two solutions is not important.

EXAMPLE 3

Figure 8:
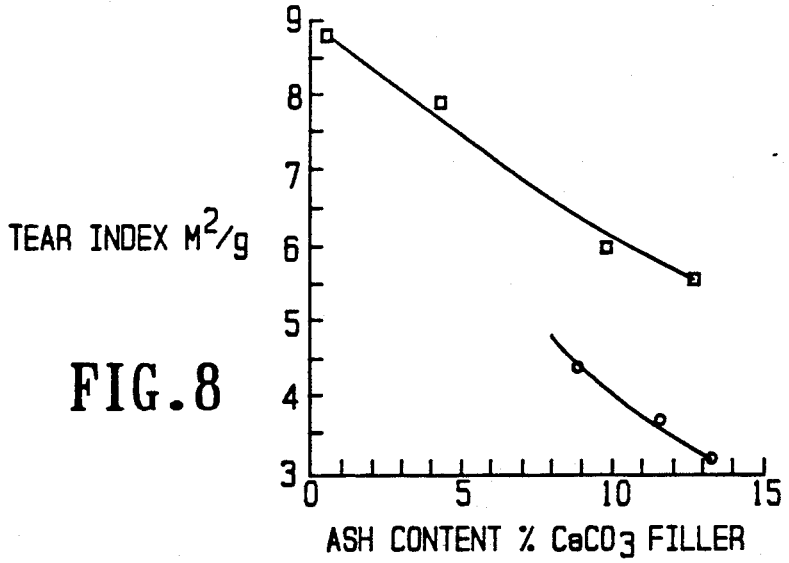
FIGS. 8, 9, and 10 illustrate the tear index, burst index, and tensile index, respectively, for different filler content papers made from spruce CTMP pulp (a softwood). The open squares represent in situ precipitated, never-dried pulp fibers filled by the inventive process. The open circles represent never-dried pulp fibers loaded in a filled paper by a conventional process described in Example 1.
Figure 9:
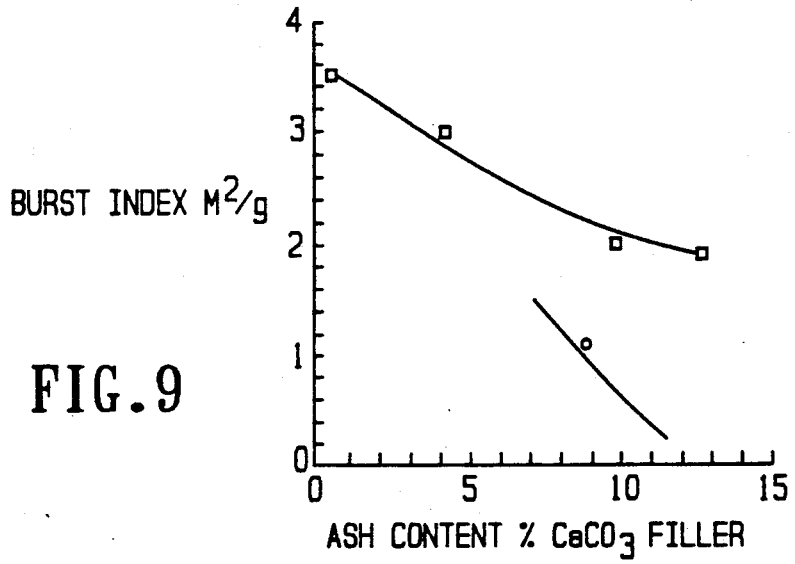
Figure 10:
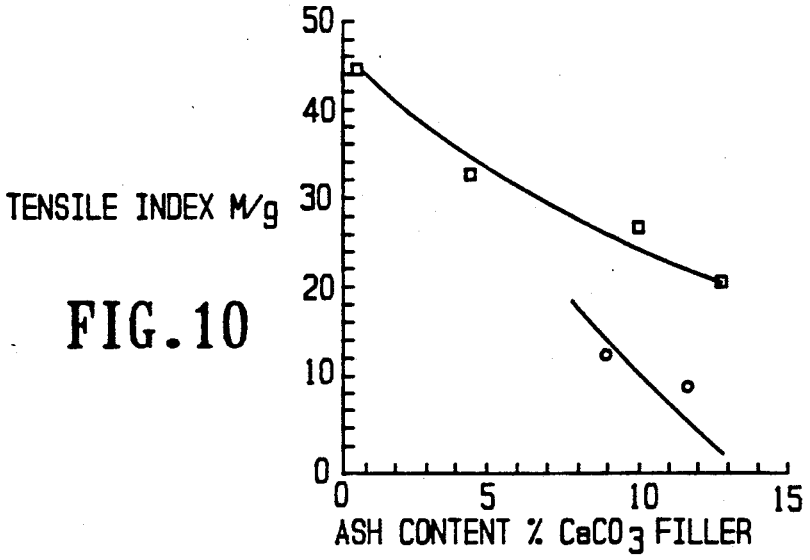

This example illustrate a comparison of spruce CTMP (chemithermomechanical pulp) never-dried pulp fibers filled by the inventive process or by conventional techniques. The never-dried fibers were initially beaten to 400 mL CSF. The inventive process and the conventional process used to fill the fibers are described in Example 1. FIGS. 8, 9, and 10 illustrate the tear index, burst index, and tensile index, respectively, of papers made from spruce CTMP never-dried pulp fibers filled by the inventive process and by the conventional technique. In each of the three figures, the inventive process is illustrated by squares and the conventional admixture process by circles.

A characteristic of spruce CTMP pulp is that the tensile, burst, and tear indices decrease faster with increasing ash contents (i.e., increasing filler contents). For each strength parameter, the paper made from never-dried pulp fibers filled by the inventive process demonstrated increased strength as compared with paper whose fibers were filled by conventional techniques.

EXAMPLE 4

This example compares bagasse pulps derived from sugarcane fibers comparing bleached and unbleached, never-dried pulps filled by the inventive method to bleached pulps that were once dried and filled by the inventive method to conventionally loaded bleached pulps. The processes used to make each paper and to combine the fibers and the filler are described in Example 1.

Figure 11:
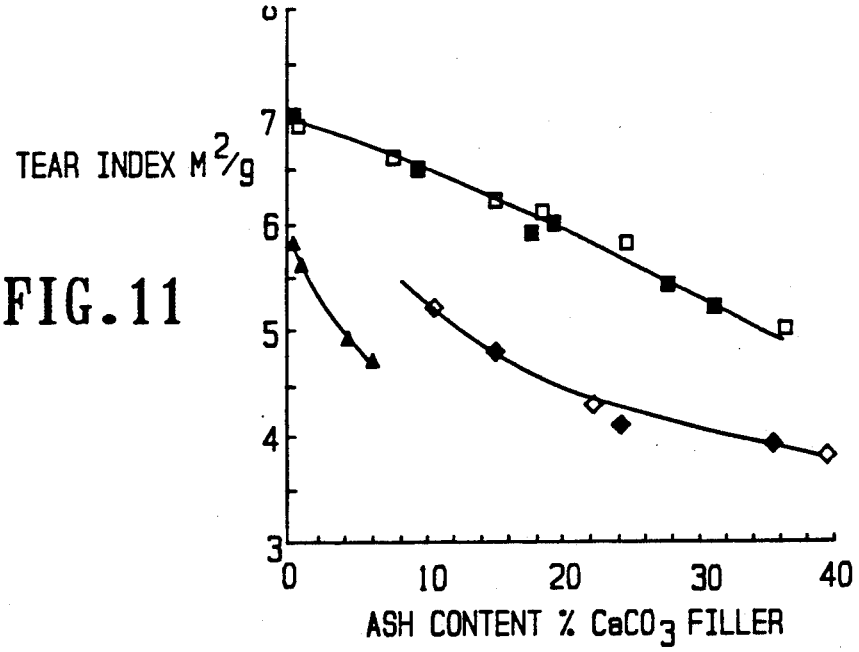
FIGS. 11, 12, and 13 illustrate the tear index, burst index, and tensile index, respectively, for different filler content papers made from bagasse pulps (sugarcane). The squares represent in situ precipitated, never-dried pulp fibers filled by the inventive process, with the filled squares being bleached pulp and the open squares being unbleached pulp. The diamonds represent never-dried pulps filled by a conventional process, as described in Example 1, with the filled diamonds being bleached pulp and the open diamonds being unbleached pulp. The triangles represent once-dried, bleached pulp filled by the inventive process. The poor results obtained with the once-dried pulps indicate that pores of the never-dried pulp fibers are necessary to be able to fill the cell walls of fibers.
Figure 12:
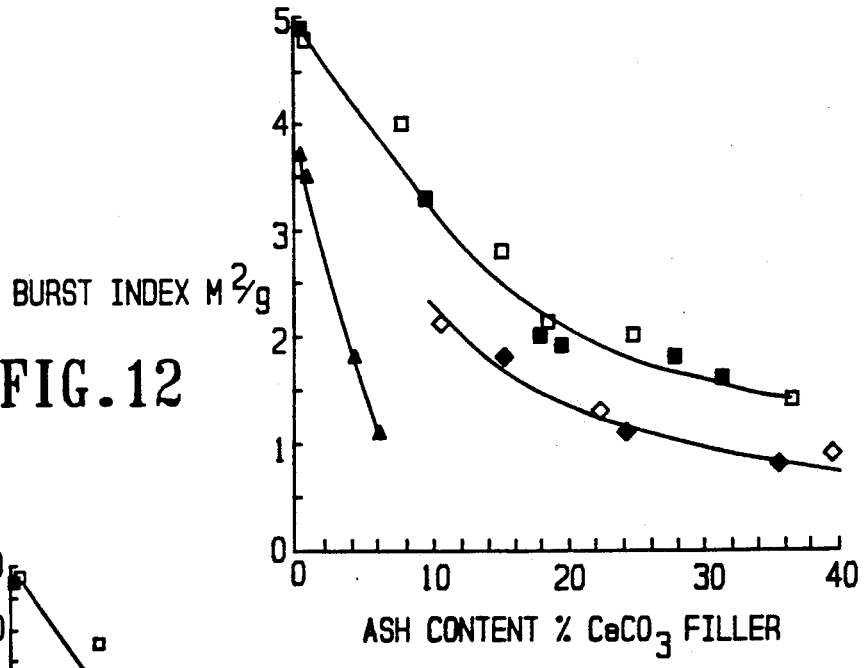
Figure 13:
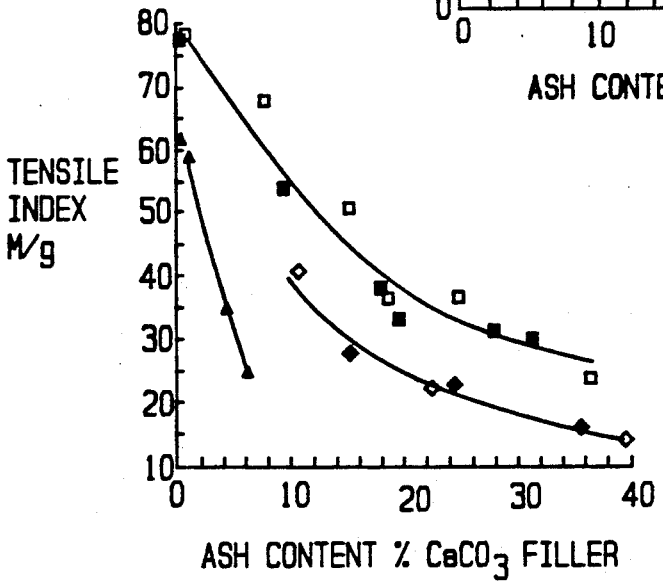

FIGS. 11, 12, and 13 illustrate the tear index, burst index, and tensile index, respectively, of each of the three types of paper. The squares illustrate the inventive process, wherein the data from paper made from bleached, never-dried pulp fibers are indicated by filled-in squares and unbleached, never-dried pulp fibers by open squares. The data from paper made from never-dried bagasse fibers loaded by the conventional process is illustrated by the triangles. The data from papers made from bleached, never-dried pulp fibers are shown by closed diamonds and unbleached, never-dried pulp fibers by open diamonds. Paper made from once-dried, bleached pulp and filled by the inventive process is shown by the triangles.

As shown in FIGS. 11, 12, and 13, paper made with never-dried bagasse pulp fibers filled by the inventive process demonstrated superior strength characteristics at each concentration of filler tested.

EXAMPLE 5

Figure 14:
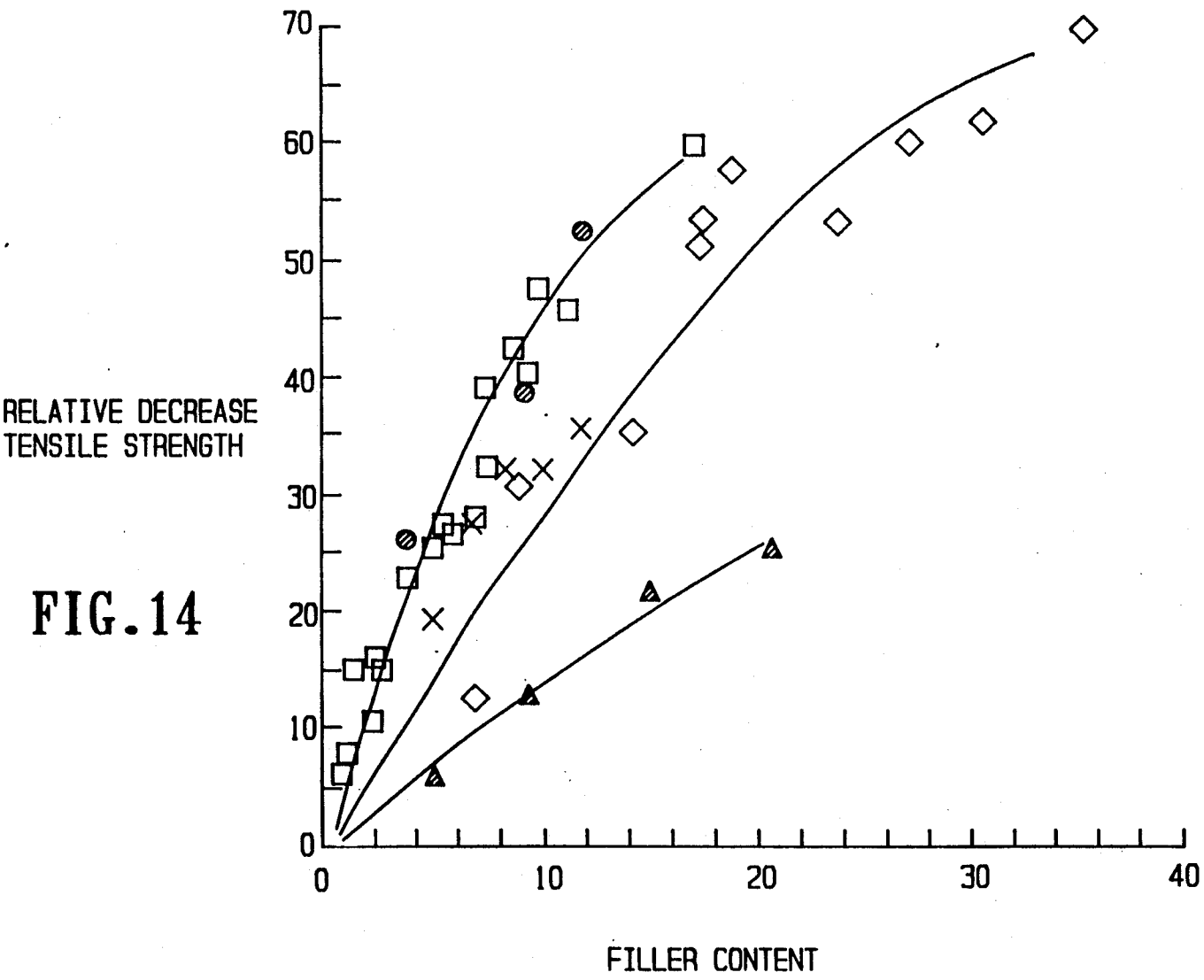
FIG. 14 compares the relative decrease in tensile strength as a function of filler content comparing literature data of the lumen-loading technique (triangles or "x" figures) to never-dried pulps filled by the inventive process using red alder hardwood pulp (open squares), bagasse sugarcane pulp (diamonds), and spruce CTMP softwood pulp (closed circles).

This example illustrates a comparison of paper tensile strength characteristics when using fibers filled by the inventive process with the lumen-loading process as described in U.S. Pat. No. 4,510,020, the disclosure of which is incorporated by reference herein. FIG. 14 illustrates the relative decrease in tensile strength of paper expressed as a percentage versus the filler content expressed as a percentage with red alder never-dried pulps, bagasse never-dried pulps, and spruce CTMP never-dried pulps filled by the inventive process as compared with lumen-loading techniques using softwoods, as derived from Miller et al. in *Proceedings* 1983 *TAPPI International Paper Physic Conference,* Harwichport, p. 237 ("Miller et al"), and Green et al., *Pulp & Paper Canada,* 83:T203 (1982) ("Green et al.").

Larger amounts of filler were loaded within hardwood never-dried pulp fibers using the inventive process when compared with Green et al.'s data for softwoods and similar amounts when compared with the Miller et al. softwoods. However, it should be noted that Miller et al. conducted their experiments with the inclusion of 2% PEI. PEI (polyethyleneimine) is a polycationic polymer which can form ionic bonds between the fibers in paper and acts to strengthen paper. PEI will function to flocculate the very fine filler particles within the lumen. The agglomeration of filler particles into larger masses improves the retention of filler inside the lumen, thus minimizing unloading mechanisms. We were able to achieve almost 40% filler loading with bagasse never-dried pulps, but at the expense of mechanical properties. The relative decrease of tensile strength of the inventive process showed the same pattern as the Green et al. data with softwood fibers. Miller et al.'s attempt showed encouraging results, but the presence of 2% PEI may have added significantly to the strength of the resulting paper.

In FIG. 14, the open squares indicate red alder never-dried pulps filled by the inventive process, the open diamonds represent bagasse pulps filled by the inventive process, the filled circles represent spruce CTMP never-dried pulps filled by the inventive process, the closed triangles represent the data in Miller et al., and the X figures represent the data in Green et al.

EXAMPLE 6

This example illustrates how never-dried eucalyptus pulp (a hardwood pulp) can be filled with aluminum hydroxide in situ. Eucalyptus pulp was dispersed in a first solution containing the soluble salt aluminum sulfate. The first solution contained a saturated concentration of aluminum sulfate at room temperature. The first solution was removed after five minutes by filtering the pulp. This also removes the first solution from the pulp lumens.

A second solution containing 20% (w/v) sodium hydroxide was used to disperse the pulp fibers. This formed aluminum hydroxide precipitated predominantly in the cell wall of the fibers.

Paper was made from the fibers filled with aluminum hydroxide filler. The amount of filler in the paper was 9% as determined by ash content of $Al_2O_3$ (alumina).

EXAMPLE 7

This example illustrates the effect of beating filled, never-dried fiber and the effect of different beating conditions. Eucalyptus (hardwood) never-dried pulp was filled with $CaCO_3$ by the inventive process as described herein. The unbeaten, never-dried pulp had a Canadian Standard Freeness (CSF) of 570 mL. A sample of the filled, never-dried pulp fibers was first beaten for 10,000 revolutions in a PFI mill (beating apparatus). The CSF value was 416 mL. The pulp was then formed into a crude first sheet by filtration onto a wire screen. The ash content of the first sheet was 43%. The pulp was then redispersed in water and refiltered to form a second sheet. The ash content of the second sheet was 38%. This process of redispersion and filtration was repeated three more times. The ash contents of the third, fourth, and fifth sheets were 34%, 36%, and 34%, respectively. Thus, approximately only 7%-9% of the filler was located outside the cell wall, even after beating for 10,000 revolutions. That is, the filler mainly stays in the cell wall during beating.

The entire procedure was repeated; except this time the filled, never-dried pulp fibers were first beaten for 20,000 revolutions, as described above. The CSF value was 366 mL. The first filtered sheet had 46% filler, the second sheet 41% filler, and the third sheet 38% filler. Thus, approximately only 8% filler was located outside of the cell wall even after beating for 20,000 revolutions.

Moreover, it is known that the pulp fibers filled by the lumen-loading technique will lose most of the filler upon beating. The inventive filling process, by contrast, does not lose an excessive amount of the filler upon beating.

From the foregoing, it will be appreciated that, although specific embodiments of the invention have been described herein for purposes of illustration, various modification may be made without deviating from the spirit and scope of the invention.

I claim:

1. A process for the production of filled pulp fiber comprising:

immersing a never-dried pulp having an internal cell wall pore volume while remaining wet after pulping in a first solution wherein the first solution comprises a soluble salt or salts, and wherein the internal cell wall pore volume of the never-dried pulp has not been substantially lost by collapse of the pores due to loss of water;

reimmersing the never-dried pulp in a second solution wherein the second solution comprises a soluble salt or salts different from the soluble salt or salts of the first solution, and wherein the internal cell wall pore volume of the never-dried pulp has not been substantially lost by collapse of the pores due to loss of water, and with the proviso that the interaction of the salt or salts from the first solution and the salt or salts from the second solution form an insoluble precipitate that acts as a filler within the cell wall of the never-dried pulp; and filtering and washing the filled never-dried pulp to form the filled pulp fiber.

2. The process of claim 1, further comprising drying the filled pulp fiber after the filtering and washing step.

3. The process of claim 1 wherein the never-dried pulp is derived from hardwoods, softwoods, annual plants, or combinations thereof.

4. The process of claim 1 wherein the insoluble precipitate is selected from the group consisting of $CaCO_3$, $AlPO_4$, $Zn(NH_4)PO_4$, $CaHPO_4$, $Ca(H_2PO_4)_2$, $Mg(NH_4)PO_4$, $Ca(BO_2)_2$, $BiPO_4$, $MgCO_3$, $Zr(HPO_4)_2$, $ZrO(H_2PO_4)$, $Al(OH)_3$, $Bi(OH)_3$, $Zn(OH)_2$, $Ti(OH)_4$, $Zr(OH)_4$, $CaSiO_3$, $BaSO_4$, $BaSiF_6$, $Ba(OH)_2$, $Ba_3(PO_4)_2$, $Ba_2P_4O_7$, $BaSiO_3$, $BaCO_3$, $BiO_2CO_3$, $CdCO_3$, $Ca(BO_2)_2.6H_2O$, $Ca(OH)_2$, $Ca_3(PO_4)_2$, $Ca_2P_2O_7.5H_2O$, $CaSO_4$, $PbCO_3$, $Mg(BO_2)_2.8H_2O$, $Mg(OH)_2$, $Mg_3(PO_4)_2$, $SrCo_3$, $SrSiO_3$, $SrSiO_4$, $Th(OH)_4$, $ZnCO_3$, $Zn_3(PO_4)_2.4H_2O$, $ZnSiO_3$, $Fe_4[Fe(CN)_6]_3$, $Fe_3[Fe(CN)_6]_2$, $Cu_3(PO_4)_2$, $Cu(OH)_2$, $CuCO_3Cu(OH)_2$, $CrPO_4.6H_2O$, $Hg_2I_2$, $HgI_2$, $AgCrO_4$, $BiI_2$, $BiI_3$, $CoCO_3$, $Co_3(PO_4)_2.8H_2O$, $Co[Fe(CN)_6]_2$, $Cu_3Fe(CN)_6.2H_2O$, $SnI_2$, $Co_3(PO_4)_2$, $Mn(NH_4)PO_4$, $Co_3(PO_4)_2.2H_2O$, $MnCO_3$, CdS, $CdMoO_4$, $BaCrO_4$, $Sb_2S_3$, $CaCrO_4.2H_2O$, $Cu_3[Fe(CN)_6]_2.14H_2O$, $PbCrO_4$, $PbI_2$, $Hg_2CO_3$, $Mo(PO_3)_6$, AgI, $Ag_3PO_4$, $SnS_2$, $Cr_4(P_2O_7)_3$, $Cu(BO_2)_2$, $CuCO_3Cu(OH)_2$, $Ni(PO_4)_2.8H_2O$, $NiCO_3$, $CrPO_4$, CuS, and combinations thereof.

5. The process of claim 1 wherein the insoluble precipitate is calcium carbonate.

6. The process of claim 1 wherein the insoluble precipitate is calcium sulfate.

7. The process of claim 1 wherein the insoluble precipitate is calcium silicate.

8. The process of claim 1 wherein the insoluble precipitate is calcium phosphate.

9. A process for the production of filled paper wherein the starting pulp is a never-dried pulp having an internal cell wall pore volume while remaining wet after pulping, comprising:

immersing the never-dried pulp is a first solution wherein the first solution comprises a soluble salt or salts, and wherein the internal cell wall pore volume of the never-dried pulp has not been substantially lost by collapse of the pores due to loss of water;

filtering the never-dried pulp from the first solution;

reimmersing the never-dried pulp in a second solution wherein the second solution comprises a soluble salt or salts different from the soluble salt or salts of the first solution, and wherein the internal cell wall pore volume of the never-dried pulp has not been substantially lost by collapse of the pores due to loss of water, and with the proviso that the interaction of the salt or salts from the first solution and the salt or salts from the second solution from an insoluble precipitate that acts as a filler within the cell wall of the never-dried pulp;

filtering and washing the filled, never-dried pulp to form a filled pulp; and forming paper with the filled pulp.

10. The process of claim 9 wherein the never-dried pulp is derived from hardwoods, softwoods, annual plants, or combinations thereof.

11. The process of claim 9 wherein the insoluble precipitate is selected from the group consisting of $CaCO_3$, $AlPO_4$, $Zn(NH_4)PO_4$, $CaHPO_4$, $Ca(H_2PO_4)_2$, $Mg(NH_4)PO_4$, $Ca(BO_2)_2$, $BiPO_4$, $MgCO_3$, $Zr(HPO_4)_2$, $ZrO(H_2PO_4)$, $AL(OH)_3$, $Bi(OH)_3$, $Zn(OH)_2$, $Ti(OH)_4$, $Zr(OH)_4$, $CaSiO_3$, $BaSO_4$, $BaSiF_6$, $Ba(OH)_2$, $Ba_3(PO_4)_2$, $Ba_2P_4O_7$, $BaSiO_3$, $BaCO_3$, $BiO_2CO_3$, $CdCO_3$, $Ca(BO_2)_2.6H_2O$, $Ca(OH)_2$, $Ca_3(PO_4)_2$, $Ca_2P_2O_7.5H_2O$, $CaSO_4$, $PbCO_3$, $Mg(BO_2)_2.8H_2O$, $Mg(OH)_2$, $Mg_3(PO_4)_2$, $SrCO_3$, $SrSiO_3$, $SrSiO_4$, $Th(OH)_4$, $ZnCO_3$, $Zn(PO_4)_2.4H_2O$, $ZnSiO_3$, $Fe_4[Fe(Cn)_6]_3$, $Fe_3[Fe(Cn)_6]_2$, $Cu_3(PO_4)_2$, $Cu(OH)_2$, $CuCO_3Cu(OH)_2$, $CrPO_4.6H_2O$, $Hg_2I_2$, $HgI_2$, $AgCrO_4$, $BiI_2$, $BiI_3$, $CoCO_3$, $CO_3(PO_4)_2.8H_2O$, $Co[Fe(CN)_6]_2$, $Cu_3Fe(CN)_6.2H_2O$, $SnI_2$, $Co_3(PO_4)_2$, $Mn(NH_4)PO_4$, $Co_3(PO_4)_2.2H_2O$, $MnCo_3$, CdS, $CdMoO_4$, $BaCrO_4$, $Sb_2S_3$, $CaCrO_4.2H_2O$, $Cu_3[Fe(Cn)_6]_2.14H_2O$, $PbCrO_4$, $PbI_2$, $Hg_2CO_3$, $Mo(PO_3)_6$, AgI, $Ag_3PO_4$, $SnS_2$, $Cr_4(P_2O_7)_3$, $Cu(BO_2)_2$, $CuCO_3Cu(OH)_2$, $Ni(PO_4)_2.8H_2O$, $NiCO_3$, $CrPO_4$, CuS, and combinations thereof.

12. The process of claim 9 wherein the insoluble precipitate is calcium carbonate.

13. The process of claim 9 wherein the insoluble precipitate is calcium sulfate.

14. The process of claim 9 wherein the insoluble precipitate is calcium silicate.

15. The process of claim 9 wherein the insoluble precipitate is calcium phosphate.

* * * * *

UNITED STATES PATENT AND TRADEMARK OFFICE

CERTIFICATE OF CORRECTION

PATENT NO. : 5,096,539

DATED : March 17, 1992

INVENTOR(S) : G. Graham Allan

It is certified that error appears in the above-identified patent and that said Letters Patent is hereby corrected as shown below:

In column 14, claim 4, line 61, Please delete "$SrCo_3$" and substitute therefor -- $SrCO_3$ --.

In column 16, claim 11, line 22, please delete "$MnCo_3$" and substitute therefor -- $MnCO_3$ --.

Signed and Sealed this

Twenty-eighth Day of September, 1993

Bruce Lehman

*Attest:*

BRUCE LEHMAN

*Attesting Officer*

*Commissioner of Patents and Trademarks*